United States Patent [19]

Nail

[11] Patent Number: 4,923,189

[45] Date of Patent: May 8, 1990

[54] METHOD FOR COMPILING SHEETS IN A BINDERY PROCESS

[75] Inventor: James W. Nail, Gastonia, N.C.

[73] Assignee: Craftsman Printing Company, Charlotte, N.C.

[21] Appl. No.: 281,174

[22] Filed: Dec. 7, 1988

Related U.S. Application Data

[62] Division of Ser. No. 40,613, Apr. 21, 1987, Pat. No. 4,799,661.

[51] Int. Cl.[5] ..... B65H 270/54

[52] U.S. Cl. ..... 270/54; 270/58

[58] Field of Search ..... 270/54, 56, 58; 271/258–263; 235/431, 432, 439, 440, 454–456, 460, 469, 470, 491, 494; 250/338–342; 209/536, 546, 547, 576–578

[56] References Cited

U.S. PATENT DOCUMENTS

| | | | |
|---|---|---|---|
| 2,172,519 | 9/1939 | Reeder | 271/62 |
| 2,801,846 | 8/1957 | Stoothoff et al. | 270/56 |
| 3,199,862 | 8/1965 | Muller | 270/54 |
| 3,245,679 | 4/1966 | Mueller | 270/53 |
| 3,262,696 | 7/1966 | Zuercher | 270/58 |
| 3,519,264 | 7/1970 | Beacham et al. | 270/54 |
| 3,525,516 | 8/1970 | Bushnell et al. | 270/58 |
| 3,804,404 | 4/1974 | Bosshard | 271/57 |
| 4,078,784 | 3/1978 | Miaskoff | 270/56 |
| 4,300,791 | 11/1981 | Bohrer et al. | 270/54 |
| 4,471,954 | 9/1984 | Bourg | 270/58 |
| 4,566,681 | 1/1986 | Bottcher | 270/58 |
| 4,580,770 | 4/1986 | Warden | 270/58 |

FOREIGN PATENT DOCUMENTS

| | | | |
|---|---|---|---|
| 135052 | 10/1980 | Japan | 270/54 |
| 151564 | 9/1982 | Japan | 270/56 |
| 156966 | 9/1982 | Japan | 270/56 |
| 160861 | 10/1982 | Japan | 270/56 |

*Primary Examiner*—Robert E. Garrett
*Assistant Examiner*—Therese M. Newholm
*Attorney, Agent, or Firm*—Bell, Seltzer, Park & Gibson

[57] ABSTRACT

A method for compiling and processing a plurality of differently printed groups of sheets into collated sets is disclosed, and wherein each of the printed sheets has an indicium printed thereon at a predetermined location, and with the predetermined location for the sheets of each group being different from the location of the indicia on the sheets of the other groups. A sheet from each of the groups is sequentially deposited onto predetermined spaced locations of an advancing conveyor to form collated sets, and a sensor is provided for scanning each sheet as it moves to the conveyor to detect whether an indicium is present at the proper predetermined location, and such that the sensor is adapted to identify an improperly collated sheet as well as a missing sheet.

7 Claims, 2 Drawing Sheets

METHOD FOR COMPILING SHEETS IN A BINDERY PROCESS

This application is a division of application Ser. No. 040,613, filed Apr. 21, 1987, now U.S. Pat. No. 4,799,661.

BACKGROUND OF THE INVENTION

This invention relates to an apparatus and method for compiling printed sheets in a bindery process and which is characterized by the ability to accurately detect a missing or incorrectly fed sheet.

The use of a collating system to build book-block sets which are then finished and bound has been a conventional practice in the bookmaking industry. These systems typically support the sheets or signatures in either a vertical or inclined stack, and a number of successively arranged feeders successively drop the sheets onto a collating chain so as to progressively build a book-block set along the chain. The collated book-block set is then finished, i.e. trimmed and bound. The success of this collating system is dependent upon the systematic placement of the proper sheet onto the collating chain in the right sequence. However, problems often develop during collating which prevent the formation of a proper book-block set. For example, a feeder may misdeliver and deposit more than one sheet onto the collating chain. Also, an incorrect sheet may be placed in a feeder, or a proper sheet may be placed incorrectly in the feeder, such as upside down, and the feeder will then deliver the wrong or misaligned sheet to the chain. Still further, the feeder sheet may misfeed completely and not even deliver a sheet, with the result that a sheet in the book-block set is missing.

Certain quality control measures have heretofore been implemented that have helped to alleviate these problems. One of the more successful quality control measures implemented to date has been the use of a mechanical caliper associated with each conveyor chain. These calipers typically employ a mechanical feeler gauge which is calibrated to measure the thickness of the several sheets of a collated set. Thus, if a feeder malfunctions and feeds a duplicate number of sheets or does not feed any sheets, the feeler gauge measures an improper thickness and signals a control device that there has been a misfeed. The control device, in turn, prevents the further finishing of that particular book-block set which is then separated from those book-block sets which are determined to be proper.

Unfortunately, the use of mechanical calipers does not indicate all possible errors. For example, a mechanical caliper cannot detect when a wrong sheet has been fed through a feeder, and also it cannot detect if a sheet has been incorrectly fed, i.e. incorrect pagination. In both these cases, the caliper would detect that sheets of proper thickness had been fed through a feeder, but the caliper would not detect that one was upside down or was the wrong sheet for that particular feeder.

It is accordingly an object of the present invention to provide an apparatus and method for compiling sheets fed onto a collating chain and which overcomes the above noted deficiencies of the prior art practices.

It is a more particular object of the present invention to provide an apparatus and method for scanning the sheets fed onto a collating chain from successively arranged feeders, and which is able to detect an incorrectly fed sheet as well as a missing sheet.

SUMMARY OF THE INVENTION

In accordance with the present invention, these and other objects and advantages are achieved, by the provision of an apparatus and method for compiling a plurality of differently printed groups of sheets into collated sets, with each of the printed sheets having an indicium thereon at a predetermined location, and with the predetermined location on the printed sheets of each group being different from the location of the indicium on the other groups of sheets, and which is characterized by the ability to accurately detect an improperly collated sheet as well as a missing sheet in each collated set. The apparatus and method includes a longitudinally directed conveyor means and a drive means for longitudinally advancing the conveyor means. Also, feeder means is provided for sequentially depositing a sheet from each of the groups of printed sheets onto predetermined spaced locations of the advancing conveyor means so as to form a set of overlying collated sheets at each of the spaced locations. The feeder means comprises a plurality of feeder stations which are positioned in a longitudinally spaced apart relation along the conveyor means with each of the feeder stations comprising a sheet supporting means which supports a stack of one of the groups of sheets, a sheet transport means which sequentially withdraws the sheets from the stack and conveys the same along a predetermined path of travel and onto the conveyor means, and a sensor means mounted along the path of travel which detects whether an indicium is present at the proper predetermined location on each of the withdrawn sheets. The sensor means is thus adapted to identify an improperly collated sheet as well as a missing sheet.

In the preferred embodiment, the sensor means comprises a light emission means and light receiving means. The light emission means emits light in the infrared range which is not appreciably reflected by a printed indicium on the sheets. The receipt of reflected light from a non-printed area of the sheet indicates the presence of a sheet from an improper group of sheets or a misaligned sheet. Also, a reflecting surface is positioned along the path of travel at a location which is normally in alignment with the indicium of each sheet, and thus any receipt of reflected light from the light reflecting surface indicates that no sheet is present. This sensor means is mounted on a support which may be adjusted along the path of travel so as to permit the recognition of indicium at different predetermined locations on the advancing sheets at each of the feeder stations.

When the sensor means determines that a printed indicium is not present at the predetermined location on a withdrawn sheet, an error signal is generated which initiates a rejection sequence in a control means. The control means correlates the error signal to the particular one of the spaced locations at which the error was generated so as to disable the processing means which is Positioned downstream of the feeder stations and which processes the set of overlying sheets at each of the spaced locations into an interconnected product. The error signal also activates a deflecting means such that the overlying sheets at the correlated spaced locations are deflected to a reject receptacle.

BRIEF DESCRIPTION OF THE DRAWINGS

Some of the objects and advantages of the present invention having been stated, others will become apparent by reference to the following drawings, in which.

DESCRIPTION OF ILLUSTRATED EMBODIMENT

Figure 1:
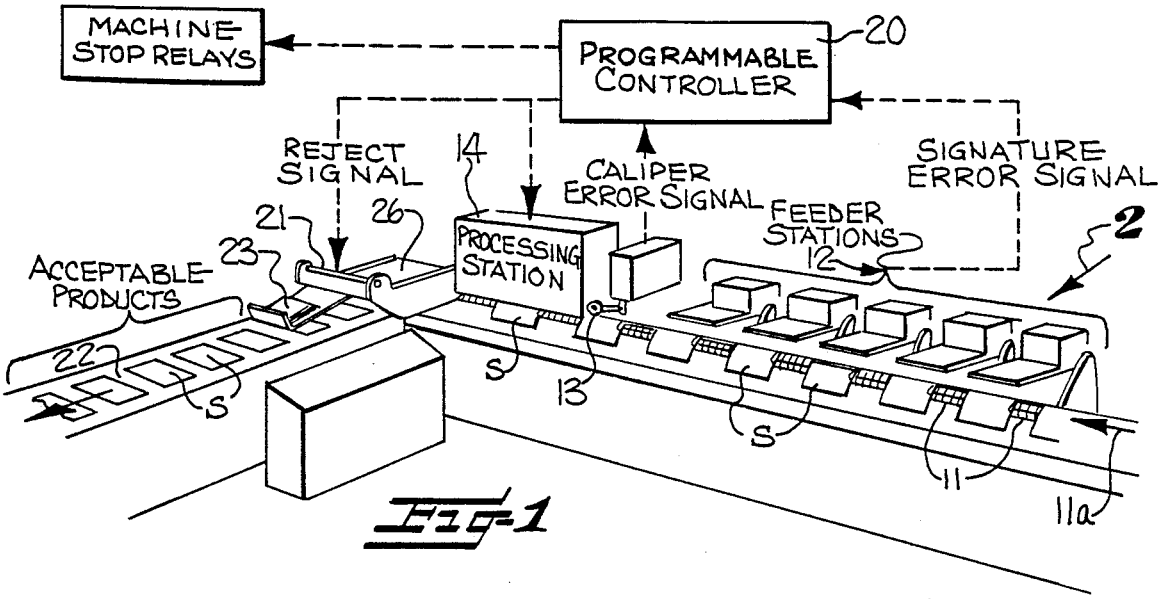
FIG. 1 is a somewhat schematic perspective view of a bindery apparatus having successively arranged feeding stations and a corresponding collating conveyor chain, and which embodies the features of the present invention.
Figure 4:
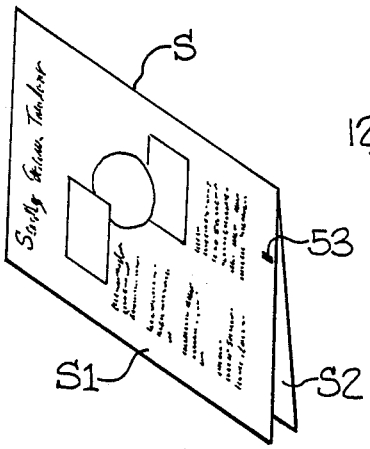
FIG. 4 is a perspective view of a printed signature showing an indicium entered onto a side edge of the sheet.

Referring now more particularly to the drawings, there is illustrated in FIG. 1 an apparatus 10 for compiling a plurality of differently printed groups of folded sheets S into collated sets. In the illustrated embodiment, each folded sheet S is folded along one edge, and includes an open opposite edge composed of separate layers S1 and S2, note FIG. 4. The apparatus 10 includes a longitudinally directed conveyor means 11, and the conveyor means is longitudinally advanced by a conventional drive means as indicated schematically by the arrow 11*a*. A plurality of feeder stations 12 are positioned in longitudinally spaced apart relation along the conveyor means 11, which sequentially deposit a folded sheet from each of the groups onto predetermined spaced locations of the advancing conveyor means 11 so as to form a set of overlying collated sheets. This conveyor means 11 is usually a chain which carries the sheets in an opened position along their folded edge. Each collated set of sheets advances along the conveyor means 11 where a mechanical caliper 13 measures the thickness of each collated set to determine whether the collated set is missing a sheet or contains too many deposited sheets. Should the mechanical caliper 13 detect that the collated set contains the proper number of collated sheets, i.e. the caliper 13 measures the standard defined for that number of collated sheets, then the collated set of sheets continues along the conveyor means 11 where it is processed at the processing station 14. Processing station 14 includes any of the conventional devices for stapling or gluing a collated set of sheets so as to bind them into an interconnected product such as a bound signature or bookblock set.

After processing, the bound product continues to a product transfer device 26 where each interconnected product is withdrawn from the conveyor means 11 and deposited onto a take-off conveyor 22. However, should the mechanical caliper 13 detect that an improper number of sheets has been deposited, i.e. the caliper 13 measures an improper thickness for the defined standard and number of collated sheets, then the caliper 13 generates an error signal to a programmable controller 20. The programmable controller 20 initiates a rejection sequence in response to the error signal from the mechanical caliper 13 which includes correlating the error signal to the particular one of the spaced locations containing the defective collated set and disabling the processing station 14 as the correlated spaced location containing the defective collated set passes through the processing station 14. Thus, the defective collated set is not processed. Also, a deflection means 21 positioned at the product transfer device 26 is activated by the error signal such that the collated set at the correlated spaced location is deflected to a reject receptacle 23.

Figure 5:
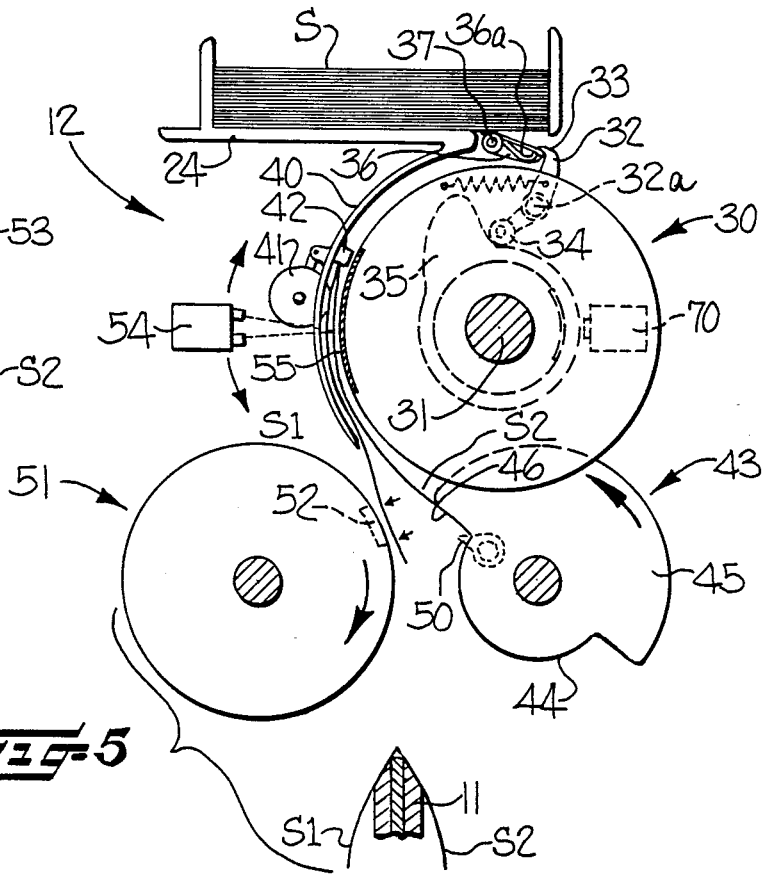
FIG. 5 is a somewhat schematic sectional side elevation view of one of the feeding stations.

In operation, each feeding station 12 feeds a sheet S onto the conveyor means 11 from a vertical stack of folded sheets supported by a sheet supporting platform 24, which in turn is mounted to a central frame 25 located above the conveyor means 11. These folded sheets are placed upon the supporting platform 24 such that their folded edge lies toward the rear, i.e. the right hand side as seen in FIG. 5. The feeder station 12 grabs the bottom-most folded sheet from the supply located in the sheet supporting means 24, and it then opens the sheet and deposits the sheet onto the conveyor means 11. Each feeder station 12 is driven via an interconnection with the drive of the conveyor means 11, which is also interconnected to the other components of the apparatus, and so that the entire apparatus 10 operates in synchronism. Thus, all the printed sheets are deposited from each feeder station 12 in a timed sequence and onto predetermined spaced locations of the advancing conveyor means 11, thus assuring that the correct sheet is properly deposited on top of the prior deposited sheets at each such location.

As best seen in FIG. 5, each feeder station 12 includes a pair of gripper drums 30 which are coaxially mounted on a shaft 31 so as to position the gripper drums 30 below the sheet supporting means 24. A gripper lever 32 is pivotally mounted between the gripper drums 30 on a pivot shaft 32*a*, with the outer end of the gripper lever 32 having a sheet gripper 33 and the inner end having a cam follower roller 34. The gripper lever 32 is spring-biased so that the roller 34 follows along the periphery of a fixed control cam surface 35 when the pair of gripper drums 30 are rotated. A suction arm 36 having a small vacuum operated suction cup 36*a* is mounted on a shaft 37 which is positioned just below the sheet supporting platform 24 and is timed to pull the bottom most sheet lying in the sheet supporting platform 24 downward at a predetermined point in the rotation of the gripper drums 30. During operation, the gripper drums 30 rotate in a clockwise direction as seen in FIG. 5. When the gripper lever 32 has reached its apex during the rotation of the drums, the suction arm 36 is automatically pushed upward by another cam and cam follower means (not shown) so as to grip the bottom most sheet lying on the sheet supporting platform 24. As the drums 30 continue to rotate, the suction arm draws that bottom most sheet downward. At the same time, the gripper lever 32 will have reached a position on the control cam surface 35 such that the gripper 33 will have engaged the sheet which had been drawn downward by the vacuum action of the suction arm 36 and suction cup 36*a*. Thus, the gripper 33 holds the sheet securely against the drums 30. As the drums 30 continue to rotate, the sheet is drawn away from the bottom of the sheet supporting platform 24 in a circumferential manner corresponding to the rotation of the drums 30. When the gripper 33 has rotated past a pressure roller 41, and drawn the sheet into a guide cylinder 40, the control cam surface 35, which acts on the gripper lever 32, forces the gripper 33 upwards so as to release the sheet. The sheet has by this time also hit a stop 42 preventing any further rotation of the sheet. The pressure roller 41 presses the sheet against the circumference of the rotating drum 30 in order to hold the sheet in a fixed, transfer position.

At this point in the feeding station 12 cycle of operation, a rear depositing drum 43 which has a semicircular portion of smaller radius 44 and a semi-circular portion of larger radius 45, begins to act upon the sheet. This larger portion 45 is narrow and is positioned so as to rotate between the gripper drums 30 in a counter clockwise direction at the same RPM as the gripper drums 30. Thus, the face 46 of this larger semi-circular portion 45 begins to push against the lower end of the sheet.

At the same time that the face 46 begins to act upon the sheet, the sheet is forced near the periphery of a rotating forward depositing drum 51, which rotates in a clockwise direction at the same RPM as the other two drums 30 and 43. This forward depositing drum 51 has two suction cups 52 on its periphery which are timed to create a vacuum at a point in time when the rotation of the forward depositing drum 51 has placed the suction cups 52 at a point juxtaposed to the sheet. Since the sheet is folded to form two folded layers S1 and S2, when the vacuum is engaged in the two suction cups 52, one layer S1 of the sheet is Pulled tightly against the periphery of that part of the forward depositing drum 51 having the suction cups 52 and the other layer is acted upon by the face 46 to the rear depositing drum 43. Positioned near the intersection point of the face 46 and the semi-circular portion of smaller radius 44 is a gripper 50 which is spring-biased and controlled by a cam follower roller and control cam surface (both not shown). The gripper 50 is timed to close against the face 46 just after the suction cups 52 have pulled the first layer S1 to the forward depositing drum 51. When the gripper 5C closes, it engages the other layer SZ and holds that layer S2 securely against the face 46. As both the forward and rear depositing drums 51 and 43 continue to rotate, with the layers S1 and S2 secured to the respective drums, the sheet is pulled progressively apart and downwardly from the guide cylinder 40. When both drums 43 and 51 have rotated so as to pull the sheet almost completely out of the guide cylinder 40, the gripper 50 is released and the vacuum from the suction cups 52 terminated. The now fully opened sheet drops onto the conveyor means 11.

During operation, since all the feeder stations 12 are the same, they operate at the same speed and in synchronous operation off the conventional drive means 11*a*. The conveyor 11 and the processing station 14 also are in synchronous operation with the feeder stations 12. Thus, the sheets are fed by each feeder station 12 in sequence assuring that each deposited sheet is advanced forward on the conveyor means 11 and placed into a position underlying the next feeder station 12 in sequence at a point in time when the next feeder station 12 deposits a sheet. A collated set of sheets is then formed along the conveyor 11. In the alternative, through a double gear system located in the bottom of each feeder station 12, the various feeder stations 12 can be operated at idle, half-speed or full-speed relative to the other feeders 12. This is advantageous, since some feeders 12 may operate at half the rate of the other feeders 12 but still deposit sheets in a set sequence. For example, the last two feeders 12 in a five feeder group may operate at half-speed and deposit wrapper sheets while the other three feeder stations 12 work at full speed and deposit inner sheets. Thus, a collated set may be produced having three inner sheets and one wrapper sheet.

After collating, the collated set is measured by the mechanical caliper 13 which determines if either too many or too few sheets have been deposited by either a misfeed or a double feed. If the mechanical caliper 13 measures the standard defined for that particular collating operation, the collated set is processed, i.e. bound, at the station 14. If the mechanical caliper 13 does not measure the standard, then an error signal is generated to the programmable controller 20 which initiates the rejection sequence in response to the error signal. The programmable controller 20 disables the processing station 14 at the correlated spaced location having the defective collated set as it passes through the processing station 14 and the defective collated set is deflected to a reject receptacle 23.

The apparatus 10 as described above is a commercially available machine, and is manufactured by Hans Muller, A.G. of Zofingen, Switzerland. Also a feeder station of the described type is further described in U.S. Pat. Nos. 3,199,862 and 3,245,679.

Figure 2:
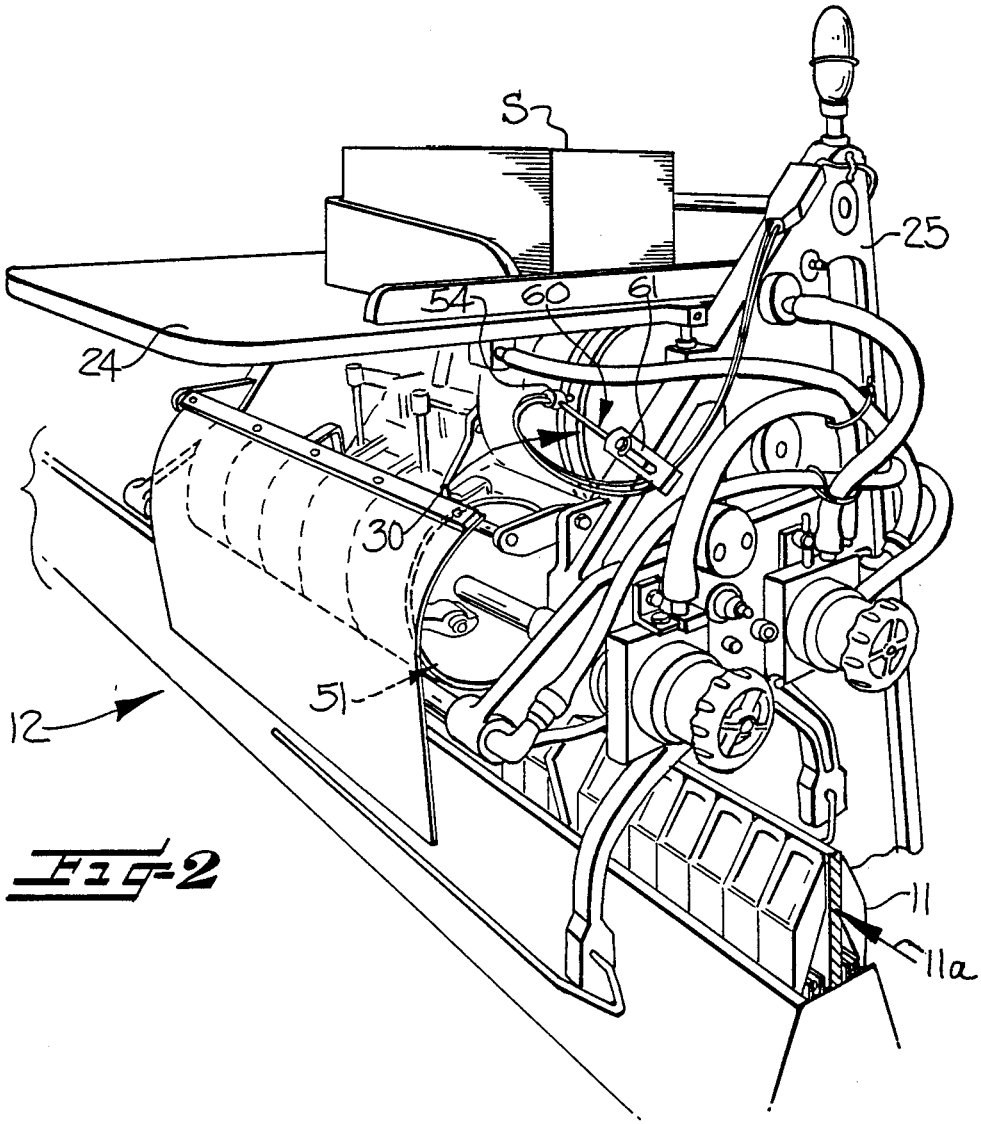
FIG. 2 is a perspective view of one of the feeding stations of the apparatus shown in FIG. 1.

As indicated above, the mechanical caliper 13 can not measure whether a wrong sheet has been fed, or whether a fed sheet has been misaligned. To alleviate this deficiency, and in accordance with the present invention, each sheet is printed with an indicium 53 at a predetermined location thereon, and with the predetermined location of the indicium 53 on the printed sheets for each group being different from the location of the indicium 53 on the other groups of sheets. This is illustrated schematically in FIG. 3, where the sheets on the several drums 30 are at different locations. In the preferred embodiment, this indicium 53 is usually a colored mark which is printed along one marginal side edge of the printed page. Also, a sensor means 54 is mounted on each feeder station 12 for detecting whether an indicium 53 is present at the proper predetermined location on each of the withdrawn sheets. The sensor means 54 is adopted to detect the indicium 53 from the side of the feeder station 12 having the forward depositing drum 51 and at the point in the sheets path of travel through the feeder station 12 when it has encountered the stop 42, i.e. at its transfer position. Thus, each indicium 53 must be printed on that side of a folded or unfolded sheet which encounters the guide cylinder 40 and forward dispositing drum 51 (FIGS. 2 and 5).

The sensor means 54 comprises a light red emission means and a light receiving means all contained within the general body of the sensor means 54. The light emission means is of such a wavelength to appear red to an observer and which is not appreciably reflected by the printed indicium 53 or the sheets. Thus, when the light receiving means receives reflected light from an area of the sheet not having the printed indicium 53, a sheet has been incorrectly fed, i.e. incorrect pagination or an improper sheet has been fed. The sensor means 54 is activated to emit the light by the closing of an electromagnetic relay 70. This electromagnetic relay 70 is operatively connected to the workings of the gripper drums 30. When the gripper drums 30 have revolved to a point corresponding to the time when a fed sheet would hit the stop 42, the electromagnetic relay 70 is closed whether or not a sheet has been fed. Even with a misfeed when no sheet is fed, the sensor means 54 will emit a light impulse.

Figure 3:
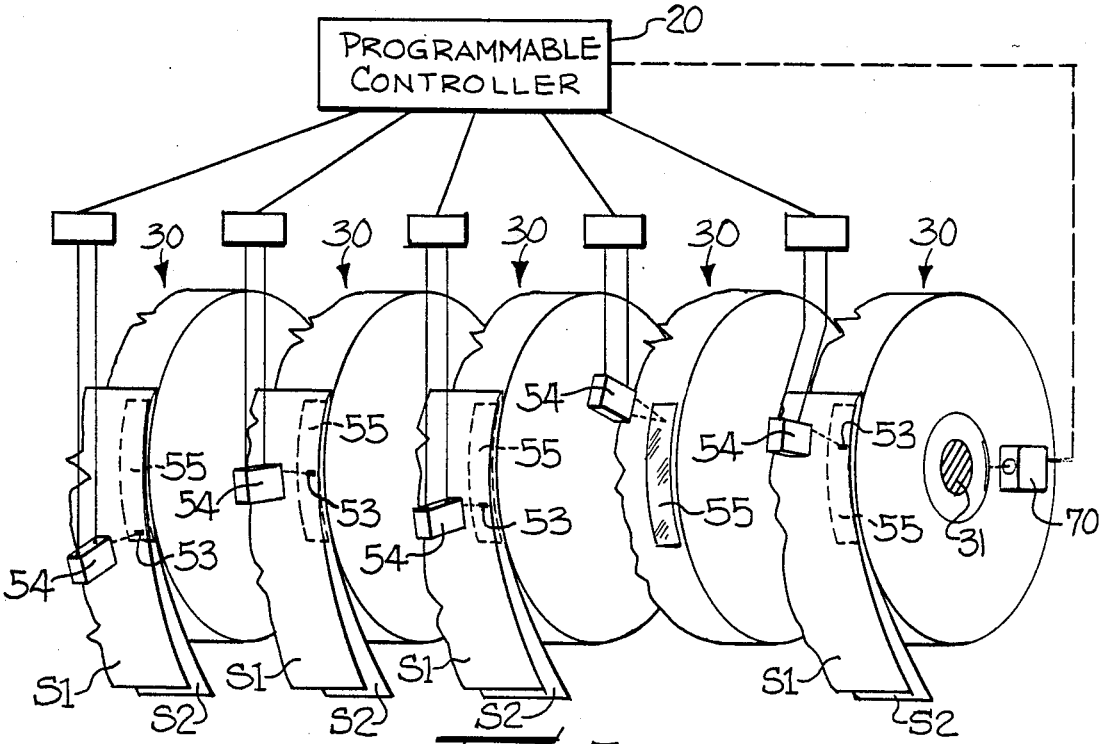
FIG. 3 is a schematic representation illustrating the scanners detecting an indicium entered onto printed sheets advancing through each feeding station.

To assure that the sensor 54 detects whenever a sheet has not been fed through a feeding station 12, a light reflecting surface 55 is positioned along the outer periphery of the gripper drums 30. In the preferred embodiment, this reflecting surface 55 comprises a reflective piece of tape secured to the outer periphery of the gripper drums 30 (FIG. 3). When a sheet is not present at the time the light impulse is generated, then the light emitted by the sensor means 54 is reflected from the reflective tape and received again by the sensor means 54 indicating that no sheet has been fed. This situation is schematically illustrated at the feeder station positioned second from the right as seen in FIG. 3.

A mounting means 60 comprising an adjustable bracket 61 is mounted to each feeder station 12 to permit the adjustment of the sensor means 54 along the sheet's path of travel so that various indicia 53 on different groups of sheets may be detected. This adjustable bracket 61 permits both axial and circumferential adjustment of the sensor along the gripper drums 30 (FIG. 2). Thus, during different collating jobs, when each job demands a new grouping of sheets having their indicia 53 on different locations on the side edges of the sheets, the sensor means 54 may be adjusted to detect that area of feeding station 12 corresponding to where an indicium 53 on a sheet would be present when that particular sheet has momentarily halted in its path of travel after it has hit the stop 42. Then, when all the sheets are changed in the sheet supporting means 24 to allow a new grouping of sheets with different indicium locations on the sheets, the location of the sensor means 54 may be adjusted to accommodate the varying location of the indicium 53 in the path of travel when the sheet has momentarily stopped after hitting the stop 42.

Like the mechanical caliper 13, the sensor means 54 acts to generate an error signal whenever a printed indicium 53 is determined not to be present at the predetermined location when the sheet has hit the stop 42. If a misfeed occurs, and no sheet is fed through the feeding station 12, then an error signal is generated when the sensor means 54 detects the return light. In the same manner, when a wrong sheet is fed or a proper sheet is fed upside down, the sensor means 54 will again not detect an indicium 53 and the error signal will be generated. As with the conventional apparatus 10, where only the mechanical caliper 13 is used, this error signal initiates in the programmable controller 20 a rejection sequence which disables the processing station 14 for that correlated spaced location corresponding to that particular feeding cycle and activates the deflection device 21 so that the defective collated set is deflected to the reject receptacle 23. Also, if three or more consecutive collated sets are defective, the programmable controller 20 automatically stops the operation of the entire apparatus 10 by activating a machine stop relay.

During operation, each sensor means 54 positioned on each feeder station 12 is adjusted so that it will detect that area of the sheet's path of travel corresponding to that area the indicium 53 occupies on a sheet when that sheet has momentarily stopped after hitting the stop 42 during the paper feeding cycle. At that point in time in the feeding cycle the sensor means 54 emits an infrared light. If no appreciable light reflection is detected, then no error signal is generated and the collated set continues on where it will be processed, i.e. bound, and then transferred to the take-off conveyor 22. If the wrong sheet is fed, or the proper sheet is fed incorrectly, or no sheet is fed, then the emitted light will be reflected by either the surface of the sheet itself since there is no indicium to absorb the light, or the light will be reflected by the light reflecting surface 55 positioned on the gripper drums 30. The error signal will be generated to the programmable controller 20 which will begin the rejection sequence for that particular collated set being formed.

It will be understood that the specification and examples are illustrative but not limiting of the present invention, and that other embodiments within the spirit and scope of the invention will suggest themselves to those skilled in the art.

What is claimed is:

1. A method of compiling a plurality of differently printed groups of sheets into collated sets, and which is characterized by the ability to accurately detect an improperly collated sheet as well as a missing sheet in each collated set, and comprising the steps of placing an indicium on each of the printed sheets at a predetermined location thereon, and with the predetermined location on the printed sheets of each group being different from the location of the indicia on the other groups of sheets, sequentially conveying a sheet from each of the groups of sheets along a predetermined path of travel and onto predetermined spaced locations of an advancing conveyor means and so as to form a set of overlying collated sheets at each of said spaced locations, and scanning each of the sheets during their advance along said path of travel and before being placed on said conveyor to detect whether an indicium is present at the proper predetermined location on each of the sheets, and so as to identify an improperly collated sheet as well as a missing sheet, with said scanning step including directing a light beam toward each sheet, and receiving a portion of the light beams which is reflected from the sheet, and with said directing and receiving steps being conducted while each sheet is at a predetermined location along said path of travel.

2. The method as defined in claim 1 comprising the further subsequent step of processing each set of overlying sheets at each of said spaced locations into an interconnected product.

3. The method as defined in claim 2 wherein the step cf scanning each of the sheets includes the further step of generating an error signal whenever an indicium is determined to be not present at the predetermined location, correlating the error signal to the particular ore of the spaced locations at which the error signal was generated, and disabling the processing step for the set of overlying sheets at the one correlated spaced location of said conveyor means.

4. The method as defined in claim 3 wherein the step of scanning each of the sheets further comprises deflecting the set of overlying sheets at the one correlated spaced location of the conveyor means upon the generation of an error signal, and so as to deflect the associated set of overlying sheets into a reject receptacle.

5. The method as defined in claim 1 wherein the sheets are folded along one edge and have an open opposite edge composed of separate layers, and wherein the step of sequentially conveying a sheet includes placing the sheet on the surface of a rotating drum, with the folded edge upstream of the open opposite edge, and so that the sheet moves circumferentially with the drum, terminating the movement of the sheet when the sheet reaches a transfer position wherein the folded edge is above the open opposite edge, and then lowering the sheet while spreading the open opposite edge and depositing the sheet in straddling relation on an underlying conveyor means.

6. The method as defined in claim 5 wherein said transfer position corresponds to said predetermined location along said path of travel.

7. The method as defined in claim 1 wherein the step of placing an indicium on each of the printed sheets includes printing an indicium thereon, and such that the light beam which is directed toward each sheet during the scanning step is not appreciably reflected by the printed indicium.

* * * * *